US006931894B2

(12) United States Patent
Yu

(10) Patent No.: US 6,931,894 B2
(45) Date of Patent: Aug. 23, 2005

(54) CABLE LOCK STRUCTURE

(76) Inventor: Chun Te Yu, No. 41-21, Kuan-Tsui St., Hsia-Nien Tsun, Fu-Hsing Hsiang, Changhua County (TW)

( * ) Notice: Subject to any disclaimer, the term of this patent is extended or adjusted under 35 U.S.C. 154(b) by 232 days.

(21) Appl. No.: 10/359,597

(22) Filed: Feb. 7, 2003

(65) Prior Publication Data

US 2004/0154358 A1 Aug. 12, 2004

(51) Int. Cl.[7] ..... E05B 73/00

(52) U.S. Cl. ..... 70/18; 24/136 R; 70/30; 70/58

(58) Field of Search ..... 70/14, 18, 30, 70/49, 58, 233; 24/136 R, 136 A, 115 M, 122.6

(56) References Cited

U.S. PATENT DOCUMENTS

| | | | | | |
|---|---|---|---|---|---|
| 351,063 | A | * | 10/1886 | McCormick | |
| 3,611,760 | A | * | 10/1971 | Muther | |
| 5,070,712 | A | * | 12/1991 | Fox | 70/18 |
| 5,181,402 | A | * | 1/1993 | Faessler et al. | 70/18 |
| 5,502,989 | A | * | 4/1996 | Murray, Jr. et al. | 70/58 |
| 5,791,170 | A | * | 8/1998 | Officer | 70/49 |
| 5,823,020 | A | * | 10/1998 | Benda | 70/18 |
| 6,212,919 | B1 | * | 4/2001 | Gerow | 70/18 |
| 6,327,752 | B1 | * | 12/2001 | Hinkey | 24/115 M |
| 6,526,785 | B1 | * | 3/2003 | Asenstorfer et al. | 70/49 |
| 6,609,399 | B1 | * | 8/2003 | Daniels, Jr. | 70/49 |
| 2003/0029207 | A1 | * | 2/2003 | Young | 70/18 |

FOREIGN PATENT DOCUMENTS

| | | | | |
|---|---|---|---|---|
| DE | 2556352 | * | 6/1977 | 70/58 |
| DE | 3938799 | * | 5/1991 | 70/14 |

* cited by examiner

*Primary Examiner*—Lloyd A. Gall
(74) *Attorney, Agent, or Firm*—Troxell Law Office PLLC

(57) ABSTRACT

Cable lock structure including a brake having a stake and a projecting bolt and a housing formed with an internal chamber for receiving therein a reciprocally movable central shaft and multiple numeral wheels fitted on the central shaft. The housing and brake are connected with a cable the length of which is adjustable. A ridge section of the housing is formed with a post hole and a cavity. The housing and the brake with small volumes can be separately respectively passed through a ring member of an article to be locked. Then the stake is inserted into the post hole and locked with the housing. The brake can be swung from an open position until the projecting bolt gets into the cavity to be latched in a close position. The total volume of the locked brake and housing is larger so that the lock body cannot be reversely drawn out of the ring member. Accordingly, the article is locked in a desired position.

23 Claims, 9 Drawing Sheets

CABLE LOCK STRUCTURE

BACKGROUND OF THE INVENTION

The present invention is related to an improved cable lock structure in which the length of the cable is adjustable for snugly locking an article without random arrangement of the cable.

Taiwanese Patent Publication Nos. 370147 and 424840 disclose a lock in which two locking bolts can be expanded to lock in a hole or a cavity formed on a fixed article. Taiwanese Patent Publication Nos. 413259 and 435561 and U.S. Pat. No. 5,502,989 disclose a lock having two relatively movable locking plates. The locking plates can be expanded and locked in the holes of an article to be locked. Taiwanese Patent Publication No. 435725 discloses a lock in which a latch block is formed at rear end of the lock housing. The latch block axially projects from the housing and is formed with a slide channel. The latch block serves to abut against a flange of the wall face of a computer housing. The lock further includes a push pin having a restoring spring. The push pin is retractable/extensible in the slide channel of the latch block. When the lock is inserted into the hole, the push pin is moved out and the latch block is forcedly biased by a certain angle to lock in the hole. U.S. Pat. No. 5,502,989 discloses a lock in which the lock bolt is pivotally rotatable. One end of the lock bolt has an elongated transversely extending stop bar for extending into a slot of an article to be locked. The lock bolt can be rotated to forcedly rotate the stop bar by a certain angle. Accordingly, the stop bar and the slot intersect each other to achieve a locking effect.

Taiwanese Patent No. 88215819, entitled "binding collar of steel cable lock ", Taiwanese Patent No. 84205898, entitled "rotatably fixing structure of steel cable end" and Taiwanese Patent No. 81208568, entitled "easy latch steel cable lock " disclose improvements of components of steel cable locks.

As shown in FIG. 1, the conventional steel cable lock has a fixed end A which is wound or fixed on a fixed article B such as a column or a desk leg. The other end of the cable is a head end C having a ring C1 which can pass through a ring member E of the fixed article D and locked with a lock F. A series of articles D such as computer mainframes can be locked at the same time to prevent the articles from being stolen. Basically, the cable C2 has a considerable length. After locking the article D, the article D can be still moved within a certain range and may be transferred or collided by other article. This is not desirable.

In addition, in practice, in order to meet different requirements, the cable C2 is often designed with longer length. As a result, excessive length of cable often remains to lead to problem of randomness. Furthermore, the conventional cable lock must be used in cooperation with the ring member E of the article. In some cases, the article may lack the ring member. For example, the cable lock can be hardly applied to a computer monitor without any ring member. Therefore, the application range of the conventional cable lock is limited.

SUMMARY OF THE INVENTION

It is therefore a primary object of the present invention to provide a cable lock structure including a lock having a housing and a brake. The housing is formed with an internal chamber for receiving therein a locking mechanism. The housing is formed with a post hole and a cavity. The brake is formed with a gate for the cable to pass therethrough. The brake has a stake formed at one end and adapted to be rotatably inserted into the post hole and a projecting bolt formed at the other end. The brake can be swung about the stake between a close position and an open position. The cable has a fixed end which can be wound around a fixed article and an operating end detained in the chamber of the housing. The lock further includes a valve having a stop pin. When the brake is swung from the open position to the close position, the projecting bolt gets into the cavity of the housing and engage with the stop pin. A restoring spring is disposed between a head end of the central shaft and the numeral wheels for constantly pushing the central shaft and the valve to a position corresponding to the cavity. When the projecting pin of the brake gets into the cavity, the stop pin is automatically inserted into a latch hole of the projecting bolt.

The housing and the brake with small volumes can be separately respectively passed through a ring member of an article to be locked. Then the stake is inserted into the post hole and locked with the housing. The brake can be swung from an open position until the projecting bolt gets into the cavity to be latched in a close position. The total volume of the locked brake and housing is larger so that the lock body cannot be reversely drawn out of the ring member. Accordingly, the article is locked in a desired position.

It is a further object of the present invention to provide the above cable lock structure in which when the brake is separated from the housing, a user can easily surround the article to be locked with the cable, especially in the case that the article has larger volume or diameter and has a neck section. The brake is separated from the housing so that the cable can easily directly surround the neck section of the article. Also, the cable can directly surround a fixed article such as a column of a building or the like. In addition, after the stake gets into the post hole, when the projecting bolt is not yet inserted into the latch hole, a user is able to adjust the diameter of the loop of the cable to an optimal length. After the projecting bolt gets into the housing and is locked with the stop pin, the brake is locked with the housing and the article. Therefore, the problem of random and excessively long reversed cable existing in the conventional device is solved. In addition, the article is prevented from being deflected or collided as happening in the conventional device.

The present invention can be best understood through the following description and accompanying drawings wherein:

DETAILED DESCRIPTION OF THE PREFERRED EMBODIMENTS

Figure 1:
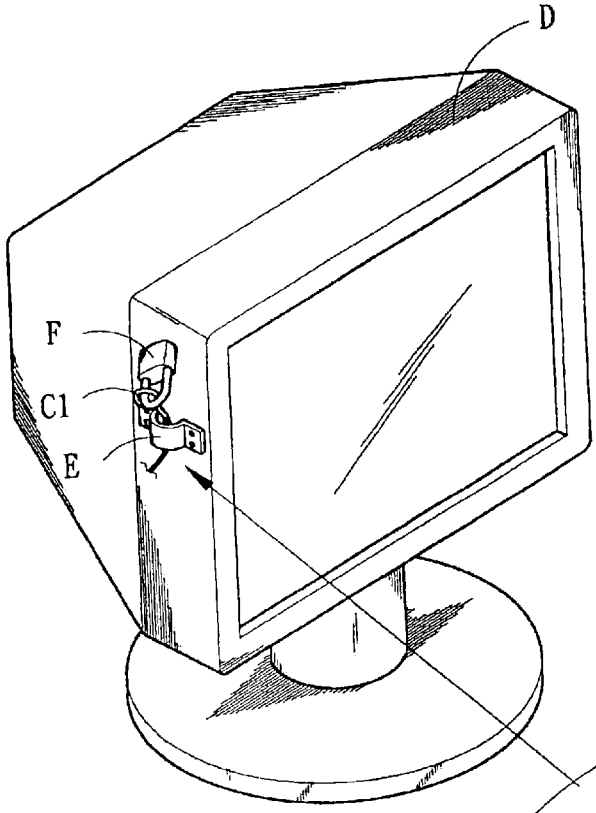
Fig. 1 (Prior Art)
FIG. 1 is a perspective view showing that a conventional cable lock is used to lock a fixed article or an article to be locked.
Figure 1A:
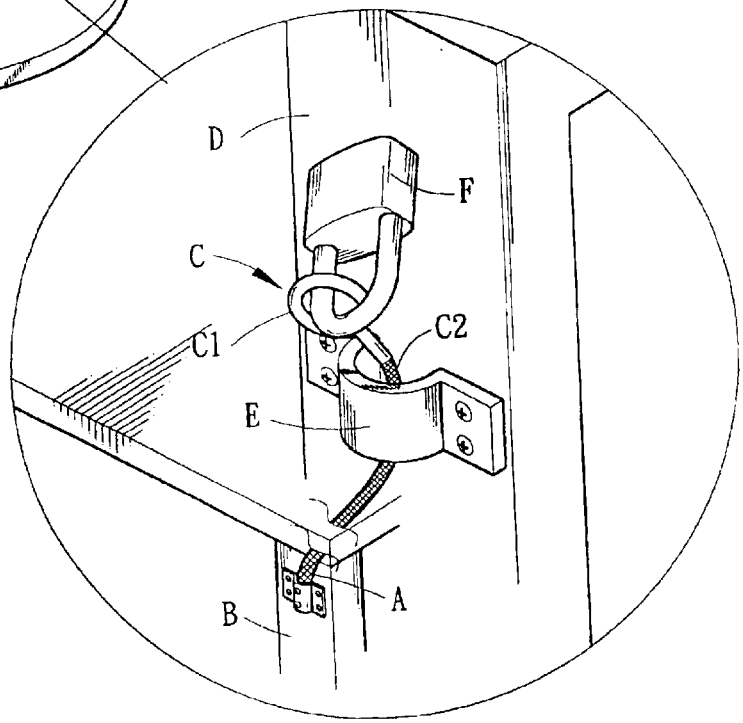
Fig. 1A (Prior Art)
FIG. 1A is an enlarged sectional view of the conventional cable lock.
Figure 2:
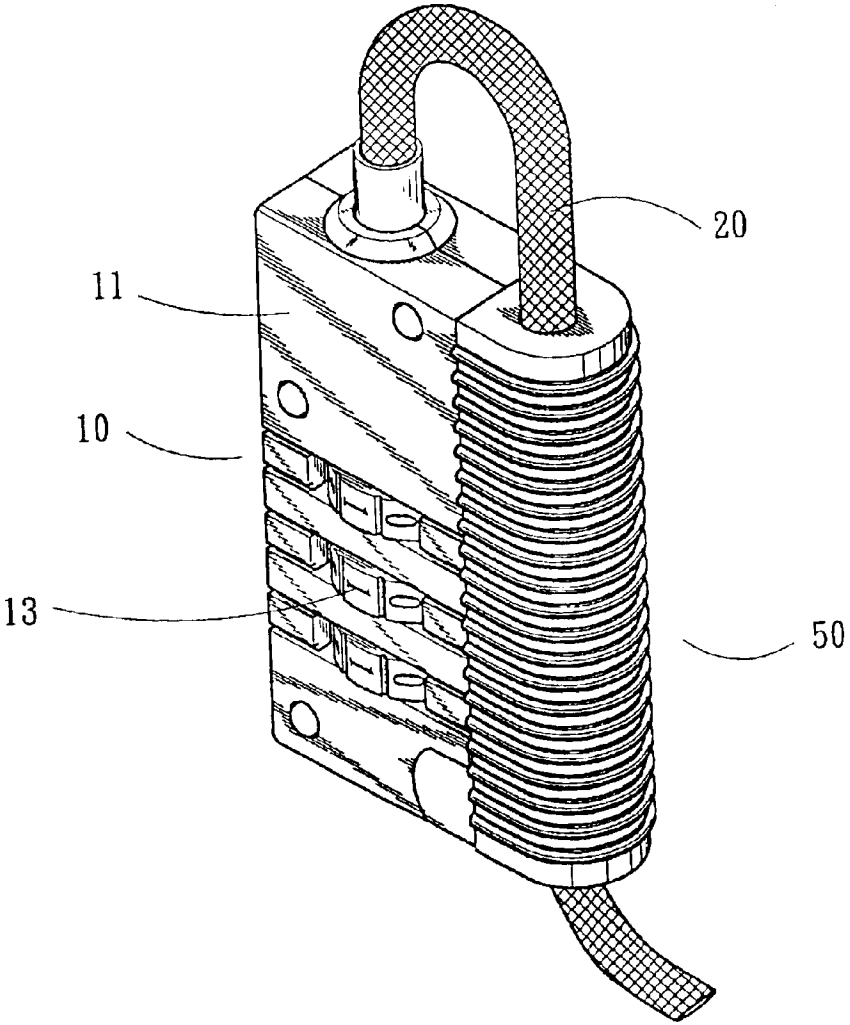
FIG. 2 is a perspective assembled view of the present invention.
Figure 3:
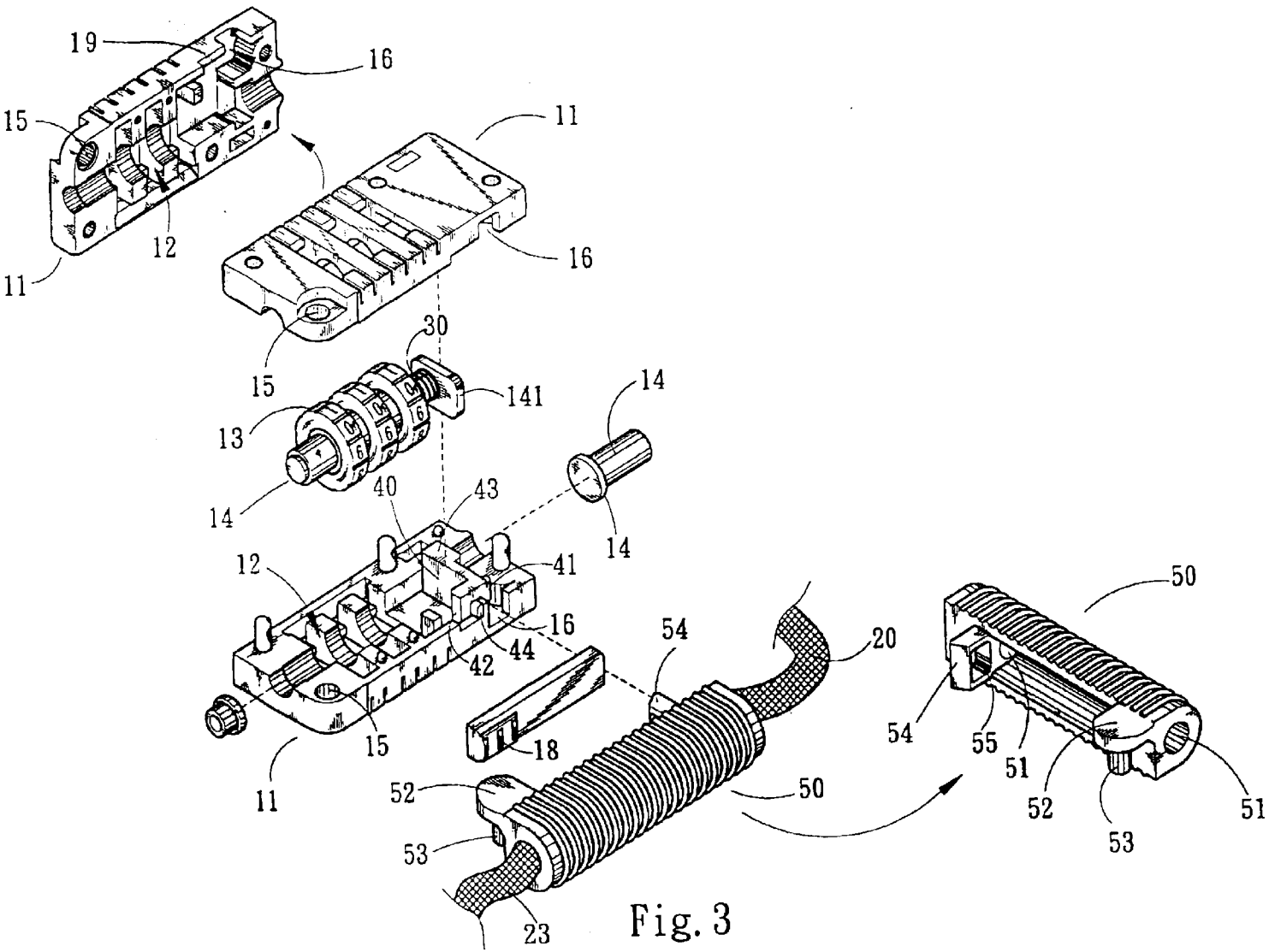
FIG. 3 is a perspective exploded view of the present invention.

Please refer to FIGS. 2 and 3. The cable lock structure of the present invention includes a lock 10 having a housing 11 defining an internal chamber 12. In a preferred embodiment, the lock is a conventional key-driven lock or a numeral lock having multiple numeral wheels 13 disposed in the chamber 12. When the numeral wheels 13 are turned to a preset position, a central shaft 14 of the lock 10 can be axially moved into an unlocked state.

Figures 4, 4A, 4B:
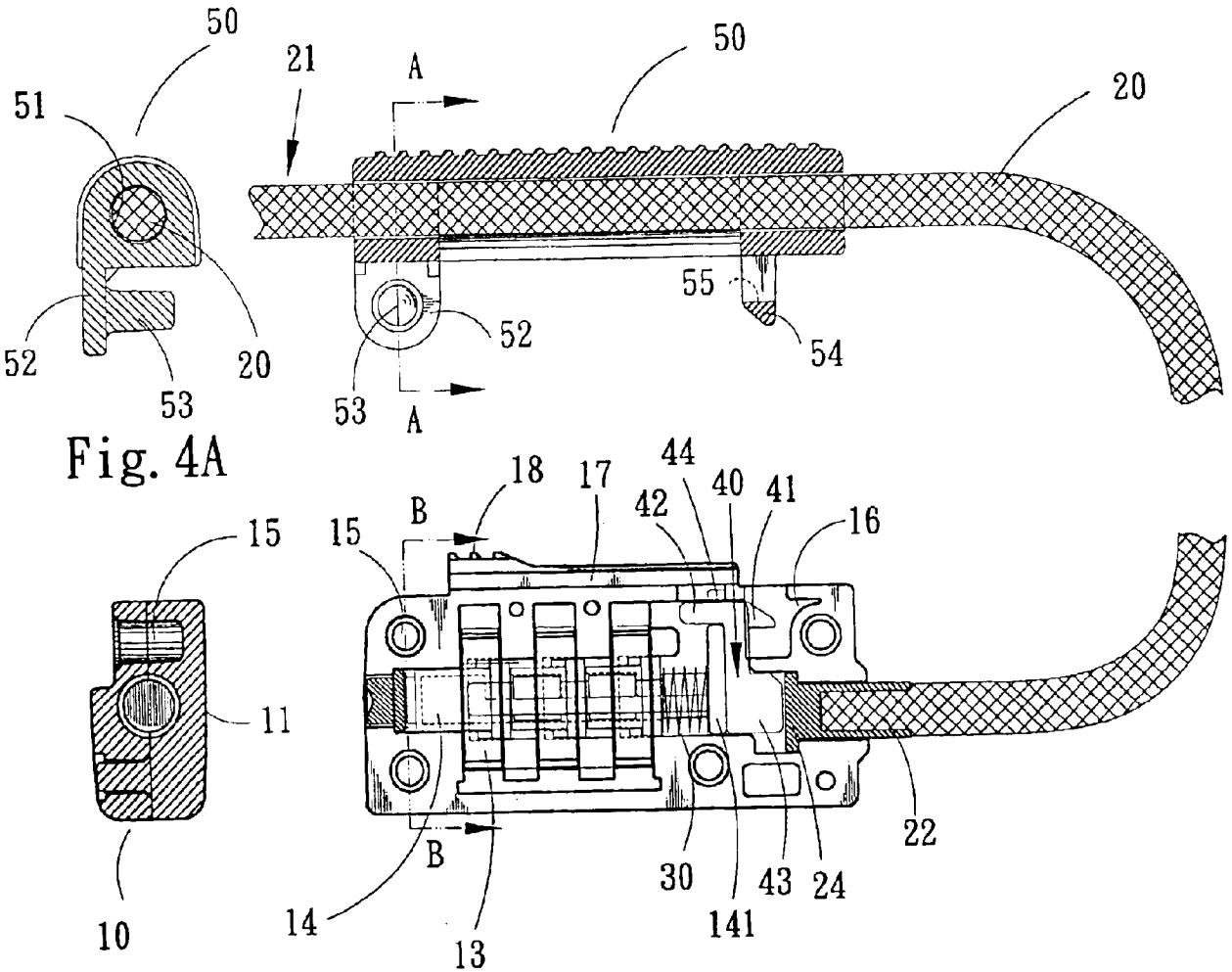
FIG. 4 is a sectional view showing that the brake and housing of the present invention are separated.
FIG. 4A is an enlarged sectional view of the brake of the present invention.
FIG. 4B is an enlarged sectional view of the housing of the present invention.

A post hole 15 is formed at one end of the housing 11 near a corner thereof. The post hole 15 extends in a direction perpendicular to the axis of the housing 11. A cavity 16 is formed at the other end of the housing 11 and outward extends from the internal chamber 12. As shown in FIG. 4, a restoring spring 30 is disposed between a head end 141 of the central shaft 14 and the numeral wheels 13 for constantly pushing the central shaft 14 to the cavity 16 on the right side of FIG. 4. A valve 40 is mounted in the housing 11 on outer or right side of the head end 141 of the central shaft corresponding to the cavity 16. An upper section 42 of the valve 40 is formed with a stop pin 41. When the central shaft 14 is pushed by the restoring spring 30 toward the cavity 16, the valve 40 is simultaneously pushed toward the cavity 16, whereby the stop pin 41 constantly naturally extends to a position inside the housing 10 corresponding to the cavity 16.

The present invention further includes a cable 20 which is coated with a gum layer 23. The cable 20 has a fixed end 21 and an operating end 22 movable along the axis of the central shaft 14 of the lock 10. As in the prior art, the fixed end 21 can be tied or fixed on a fixed article $\chi$ such as a column or a desk leg. The operating end 22 has a large diameter section 24 detained in the chamber 12 of the housing 11, whereby the operating end 22 cannot be detached from the housing 11. A hammer section 43 of the valve 40 abuts against the large diameter section 24.

Referring to FIGS. 3 and 4, the present invention further includes a brake 50 having a gate 51 permitting the cable 20 to pass therethrough from one end to the other end. The inner diameter of the gate 51 is such that a slight damp is exerted against the cable 20 extending through the gate 51. In the case that external force is greater than the damping effect, the cable 20 can be drawn and moved along the gate 51 to change the position of the brake 50 relative to the cable 20. (The usage will be further described hereafter.) The brake 50 further has a stake 53 formed on a perpendicular lug 52 of the brake 50 at one end thereof and a projecting bolt 54 formed at the other end of the brake 50 opposite to the stake 53. The stake 53 is detachably rotatably inserted in the post hole 15 of the housing 11 in a direction perpendicular to the axis of the housing 11. The end of the brake 50 with the projecting bolt 54 is swingable about the stake 53 between a close position and an open position. The projecting bolt 54 of the brake 50 has a latch hole 55. When the brake 50 is positioned in the locking position, the projecting bolt 54 can extend into the cavity 16 of the housing 11, whereby the stop pin 41 of the valve 40 can be engaged in the latch hole 55. (This will be further described hereafter with reference to FIGS. 5 and 6.)

Figure 5:
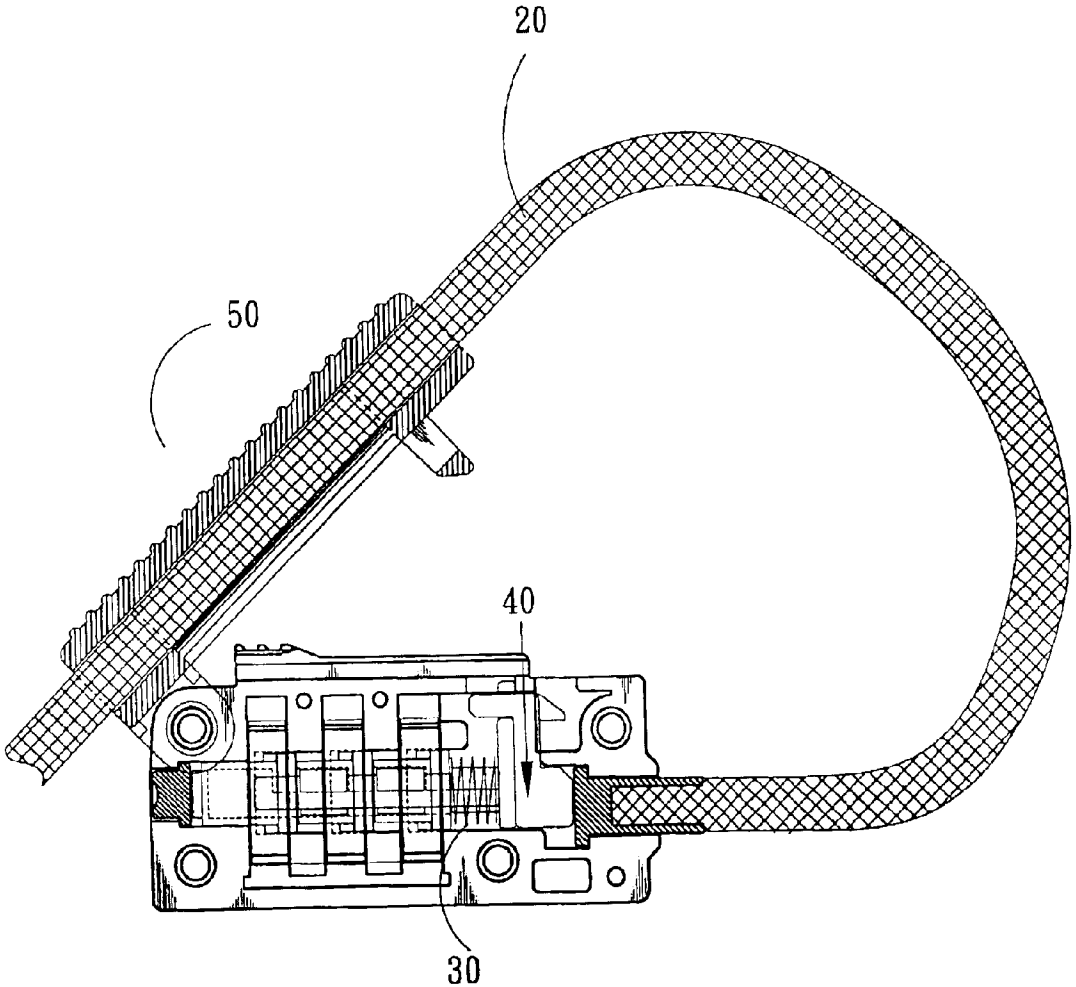
FIG. 5 is a sectional view showing that the stake of the brake is inserted in the post hole of the housing of the present invention.
Figures 6, 6A:
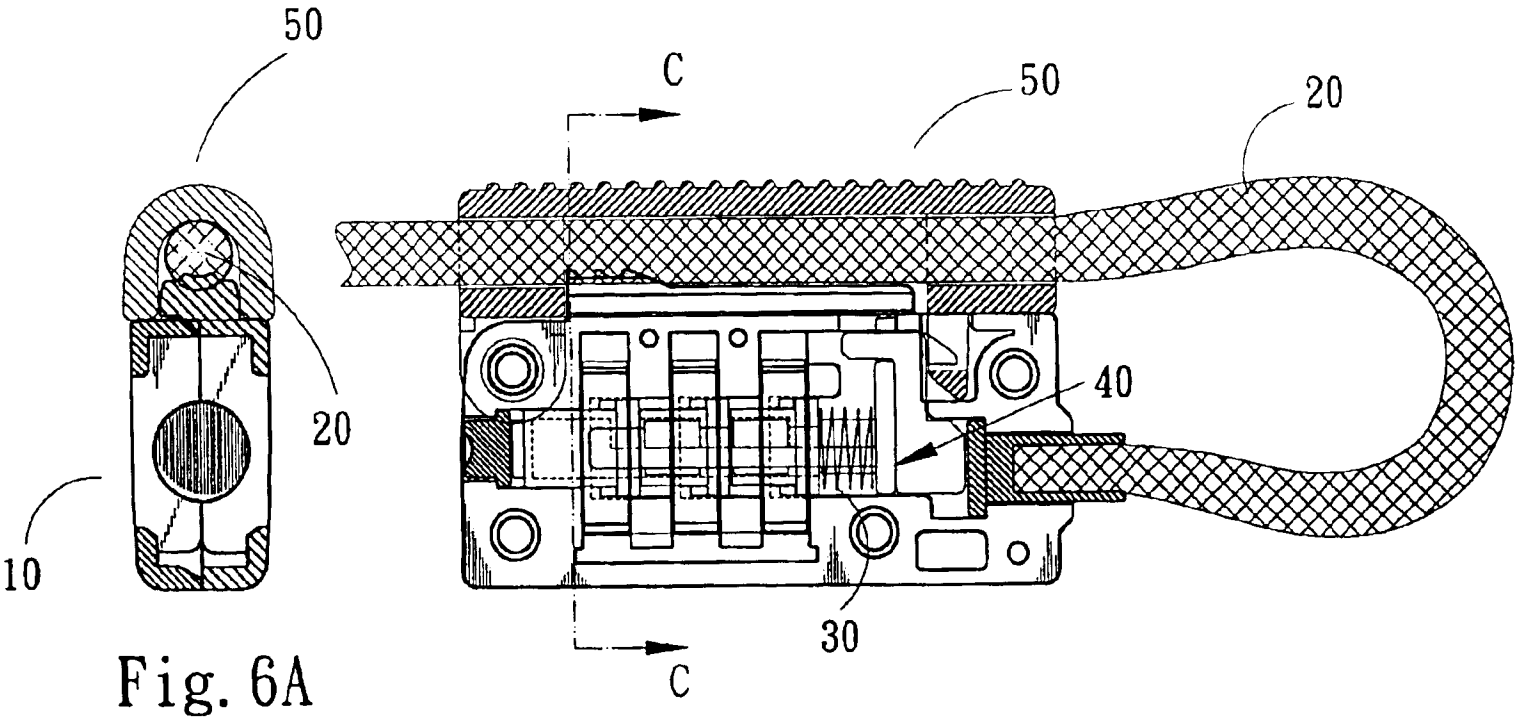
FIG. 6 is a sectional view showing that projecting bolt of the brake is inserted in the cavity of the housing of the present invention.
FIG. 6A is a cross-sectional view according to FIG. 6.
Figure 8:
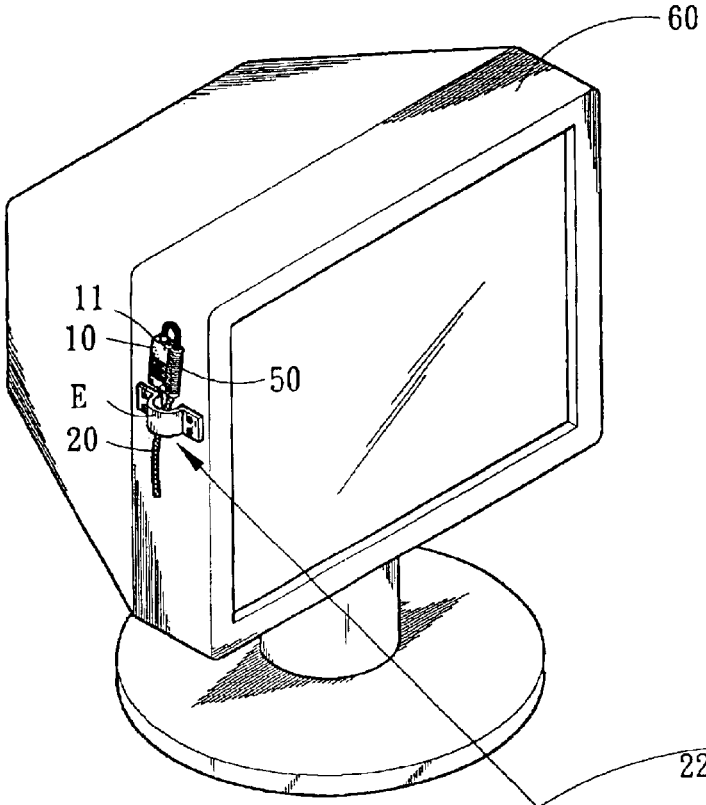
FIG. 8 shows that the present invention is used in cooperation with the ring member of a fixed article or an article to be locked.
Figure 8A:
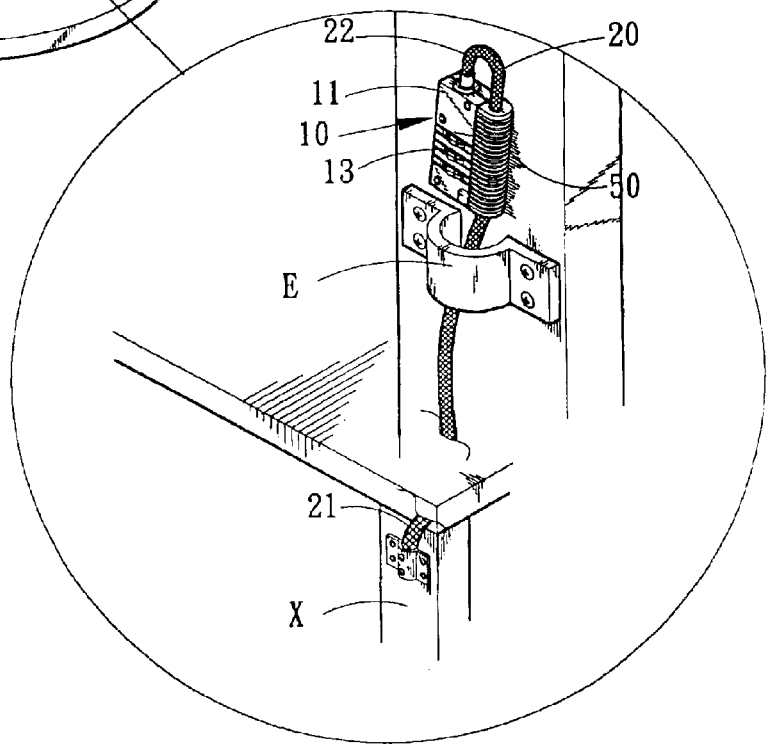
FIG. 8A is an enlarged sectional view of FIG. 8.

In practical operation, the housing 11 and the brake 50 with small volumes are separately respectively passed through the hook latch member of one or several fixed articles or articles 60 to be locked, such as a ring member E of a computer mainframe. Then the stake 53 is inserted into the post hole 15 of the housing 11. FIG. 5 shows that the brake 50 is positioned in the open position. In this state, the brake 50 can be swung about the stake 53 toward the close position as shown in FIG. 6 until the projecting bolt 54 of the brake 50 gets into the cavity 16 of the housing 11 and the stop pin 41 inserted into the latch hole 55 of the projecting bolt 54. At this time, the brake 50 is locked with the housing 11. The total height, weight or volume of the locked brake 50 and housing 11 is apparently larger than the diameter of the hole of the ring member E. Therefore, the locked bodies cannot be drawn out of the ring member E through the original path. Accordingly, the lock 10 and cable 20 lock the fixed article 60 as shown in FIG. 8.

Figure 7:
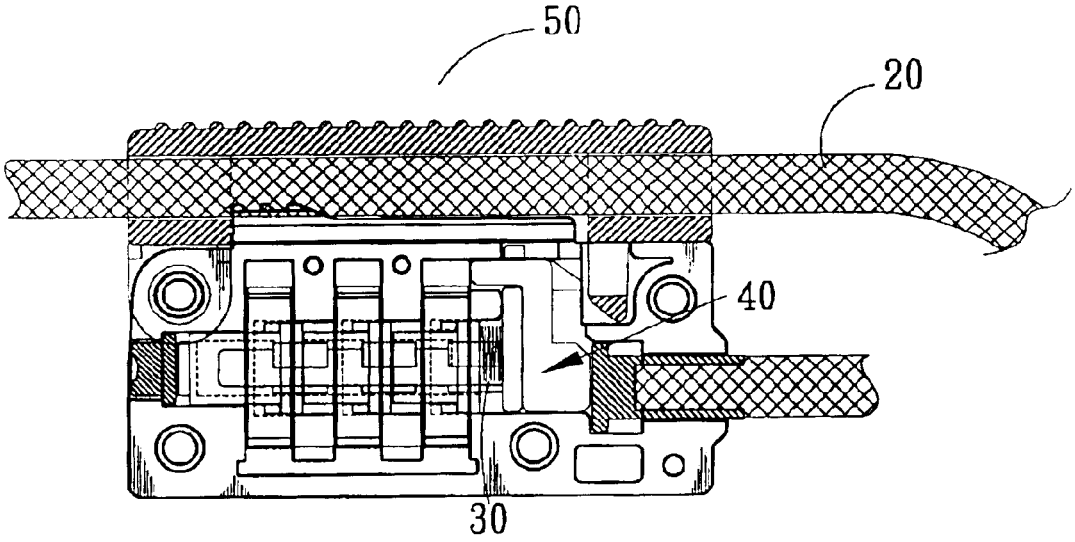
FIG. 7 shows that the action of the valve of the present invention when the central shaft of the lock is permitted to be pushed.

Referring to FIG. 7, when the numeral wheels 13 of the lock are turned by an operator to an unlocking position or number, the central shaft 14 is permitted to axially move. At this time, the operator can push the operating end 22 of the cable toward inner side of the housing to make the valve 40 and the central shaft 14 displace in the same direction to compress the restoring spring 30. At this time, the stop pin 41 of the valve 40 is unlatched from the latch hole 55 of the projecting bolt 54, permitting the brake 50 to swing back to the open position as shown in FIG. 5 or the separation state from the housing as shown in FIG. 4.

Basically, FIG. 5 shows that the cable 20 is in a relatively natural state. In the case that the cable is in the state as shown in FIG. 6, the cable 20 is bent and an action force exists for pushing the housing 11 to separate from the brake 50. Accordingly, a reaction force is reserved in the bent cable 20. When the stop pin 41 of the valve 40 is positioned in the unlatching position as shown in FIG. 7, the reserved reaction force helps in automatically bounding the brake 50 to the open position as shown in FIG. 5.

Figure 9:
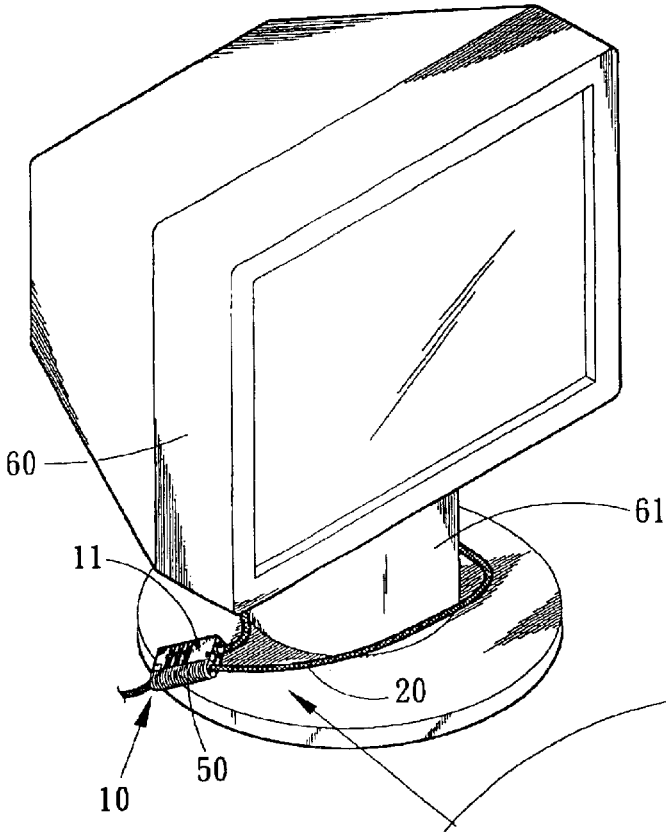
FIG. 9 shows that the present invention is applied to a fixed article or an article to be locked without any ring member.
Figure 9A:
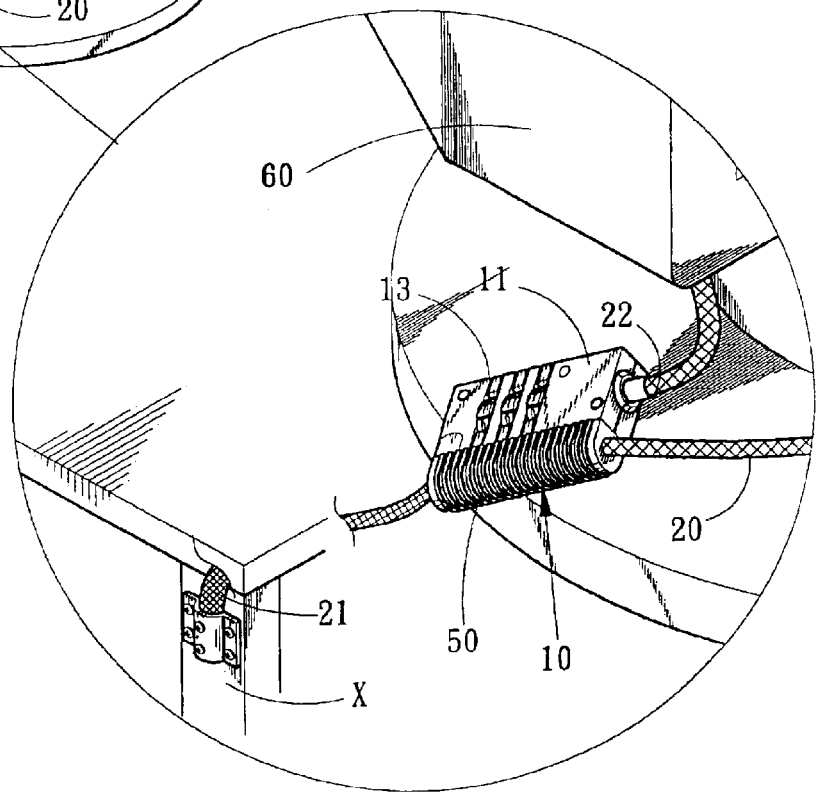
FIG. 9A is an enlarged sectional view of FIG. 9

Please refer to FIG. 4 or 5, as aforesaid, when the external force is greater than the damping effect between the gate 51 of the brake and the cable 20, the position of the brake 50 relative to the cable 20 can be adjusted. Accordingly, an operator can adjust the length of the cable 20 on left and right sides of the brake 50 in accordance with the condition of the environment. Therefore, the problem of random and excessively long reversed cable existing in the conventional device is solved. In addition, in comparison with the conventional device, the length of the cable 20 is adjustable so that the article 60 to be locked can be possibly kept in a desired position. Therefore, the article is prevented from being deflected or collided as happening in the conventional device. In special application situation such as a computer monitor without ring member E is to be locked, referring to FIG. 4, the cable 20 between the brake 50 and the housing 11 is adjustable to have longer length for surrounding a neck section under the monitor as shown in FIG. 9. Accordingly, the application range of the cable lock of the present invention is wider.

It should be noted that when the brake 50 is separated from the housing 11, a user can easily surround the article 60 to be locked with the cable 20, especially in the case that the article 60 has larger volume or diameter and has a neck section 61 as typically shown in FIG. 9. The brake 50 is separated from the housing 11 so that the cable 20 can easily directly surround the neck section 61 of the article 60. Also, the cable 20 can directly surround a fixed article such as a column of a building or the like. In addition, after the stake 53 gets into the post hole 15, when the projecting bolt 54 is not yet inserted into the cavity 16, a user is able to adjust the diameter of the loop of the cable 20 to an optimal length. After the projecting bolt 54 gets into the housing 11 and is locked with the stop pin 41, the brake 50 is locked with the housing and the article.

In a preferred embodiment of the present invention, at least a part of a ridge section 17 of the housing 11 is formed with a racket section 18. When the brake 50 is positioned in the close position as shown in FIG. 6, the racket section 18 aids in pressing the cable 20 and preventing the cable 20 from moving. This helps in locating the cable 20 after the length thereof is, adjusted and possibly restricting the locked article 60 in the desired position. In a modified embodiment, the racket section 18 is formed on any contact face of the brake 50 in contact with the cable, 20, such as inner surface of the gate 51.

In another embodiment of the present invention, the valve 40 further includes a tenon 44 formed on an upper section 42 of the valve 40. When the valve 40 is mounted in the chamber 12 of the housing, the tenon 44 is positioned on a rail 19 formed on inner end face of the chamber 12, whereby the tenon 44 can move along the rail 19 to enhance the stability of the movement of the valve 40.

The above embodiments are only used to illustrate the present invention, not intended to limit the scope thereof. Many modifications of the above embodiments can be made without departing from the spirit of the present invention. For example, the position of the brake 50 on the cable 20 can be changed, that is, the brake 50 can be fixed at rear end of the cable 20, while a gate is formed in the lock 10 for the cable 20 to pass therethrough. When the projecting bolt 54 of the brake 50 is latched into the cavity 16 of the lock 10, the projecting bolt 54 can simultaneously press and brake the cable 20.

What is claimed is:

1. Cable lock structure comprising a lock including:

a housing formed with an internal chamber for receiving therein a locking mechanism, a ridge section of the housing being formed with a post hole and a cavity;

a brake formed with a gate between two ends, the brake having a stake formed at one end and adapted to be rotatably inserted into the post hole and a projecting bolt formed at the other end, whereby the brake can be swung about the stake between a close position and an open position;

a cable having a fixed end which can be wound around a fixed article and an operating end detained in the chamber of the housing, the cable passing through the gate; and a valve having a stop pin, whereby when the brake is swung from the open position to the close position, the projecting bolt gets into the cavity of the housing and engage with the stop pin.

2. Cable lock structure as claimed in claim 1, wherein the post hole of the housing extends in a direction perpendicular to an axis of the housing.

3. Cable lock structure as claimed in claim 1, wherein the stake of the brake is formed on a perpendicular lug of the brake in a direction perpendicular to the axis of the housing, whereby when the stake is inserted into the post hole of the housing, the brake can be swung between an open position and a close position.

4. Cable lock structure as claimed in claim 2, wherein the stake of the brake is formed on a perpendicular lug of the brake in a direction perpendicular to the axis of the housing, whereby when the stake is inserted into the post hole of the housing, the brake can be swung between an open position and a close position.

5. Cable lock structure as claimed in claim 1, wherein the lock is a numeral lock including a reciprocally movable central shaft and multiple numeral wheels serially fitted on the central shaft.

6. Cable lock structure as claimed in claim 5, wherein a restoring spring is disposed between a head end of the central shaft and the numeral wheels for constantly pushing the central shaft and the valve to a position corresponding to the cavity.

7. Cable lock structure as claimed in claim 1, wherein the stop pin of the valve is pushed by a restoring spring to constantly extend into the cavity.

8. Cable lock structure as claimed in claim 6, wherein the stop pin of the valve is pushed by a restoring spring to constantly extend into the cavity.

9. Cable lock structure as claimed in claim 7, wherein the stop pin of the valve is formed on an upper section of the valve.

10. Cable lock structure as claimed in claim 1, wherein the cable is coated with a gum layer.

11. Cable lock structure as claimed in claim 5, wherein the cable is coated with a gum layer.

12. Cable lock structure as claimed in claim 1, wherein the operating end of the cable has a large diameter section detained in the chamber of the housing, the valve abutting against the large diameter section.

13. Cable lock structure as claimed in claim 5, wherein the operating end of the cable has a large diameter section detained in the chamber of the housing, the valve abutting against the large diameter section.

14. Cable lock structure as claimed in claim 1, wherein a damping effect is generated between the gate of the brake and the cable.

15. Cable lock structure as claimed in claim 5, wherein a damping effect is generated between the gate of the brake and the cable.

16. Cable lock structure as claimed in claim 1, wherein the projecting bolt of the brake has a latch hole, whereby when the projecting bolt gets into the cavity of the housing, the stop pin is inserted into the latch hole and latched therein.

17. Cable lock structure as claimed in claim 5, wherein the projecting bolt of the brake has a latch hole, whereby when the projecting bolt gets into the cavity of the housing, the stop pin is inserted into the latch hole and latched therein.

18. Cable lock structure as claimed in claim 1, wherein at least a part of the ridge section of the housing is formed with a racket section in a position corresponding to the brake.

19. Cable lock structure as claimed in claim 5, wherein at least a part of the ridge section of the housing is formed with a racket section in a position corresponding to the brake.

20. Cable lock structure as claimed in claim 1, wherein the valve further includes a tenon formed on an upper section of the valve, whereby when the valve is mounted in the chamber of the housing, the tenon is positioned on a rail formed in a position adjacent to the chamber, whereby the tenon can move along the rail.

21. Cable lock structure as claimed in claim 5, wherein the valve further includes a tenon formed on an upper section of the valve, whereby when the valve is mounted in the chamber of the housing, the tenon is positioned on a rail formed in a position adjacent to the chamber, whereby the tenon can move along the rail.

22. Cable lock structure as claimed in claim 9, wherein the valve further includes a tenon formed on an upper section of the valve, whereby when the valve is mounted in the chamber of the housing, the tenon is positioned on a rail formed in a position adjacent to the chamber, whereby the tenon can move along the rail.

23. Cable lock structure comprising a lock including:

a housing formed with an internal chamber for receiving therein a locking mechanism, a ridge section of the housing being formed with a post hole and a cavity, the housing being formed with a gate passing through the housing, a cable being passed through the gate;

a brake one end of which is fixed at a rear end of the cable, the brake having a stake formed at one end and adapted to be rotatably inserted into the post hole and a projecting bolt formed at the other end, whereby the brake can be swung about the stake between a closed position and an open position;

the cable having a fixed end which can be wound around a fixed article and an operating end detained in the chamber of the housing; and a valve having a stop pin, whereby when the brake is swung from the open position to the close position, the projecting bolt gets into the cavity of the housing and engage with the stop pin and simultaneously press the cable.

* * * * *